US005974707A

United States Patent [19]

Kowalczyk

[11] Patent Number: 5,974,707

[45] Date of Patent: Nov. 2, 1999

[54] APPARATUS FOR THE DISPLAY OF TILE SECTIONS

[76] Inventor: Michael J. Kowalczyk, P.O. Box 90878, Houston, Tex. 77290

[21] Appl. No.: 09/157,834

[22] Filed: Sep. 21, 1998

[51] Int. Cl.[6] ..... G09F 1/10

[52] U.S. Cl. ..... 40/124.4; 40/124; 211/189; 211/206; 248/127

[58] Field of Search ..... 40/124.4, 124, 40/610; 211/41.1, 41.2, 189, 206; 248/150, 152, 127, 473; 446/111, 113, 115, 108

[56] References Cited

U.S. PATENT DOCUMENTS

| | | | |
|---|---|---|---|
| 905,578 | 12/1908 | Read | 40/124.4 |
| 2,135,093 | 11/1938 | Abrams | 248/152 |
| 3,079,003 | 2/1963 | Hilsinger, Jr. | 211/189 X |
| 3,179,479 | 4/1965 | Freedman | 40/124 |
| 5,012,937 | 5/1991 | Owens | 40/124 X |
| 5,281,181 | 1/1994 | McCollum | 446/108 X |
| 5,289,926 | 3/1994 | Lewis et al. | 40/124 X |

*Primary Examiner*—Terry Lee Melius
*Assistant Examiner*—Rodrigo J. Morales
*Attorney, Agent, or Firm*—Harrison & Egbert

[57] ABSTRACT

An apparatus for the display of tile sections having a first side panel with a plurality of tile-receiving slots extending along at least a portion of a top edge of the first side panel, a second side panel with a plurality of tile-receiving slots extending along at least a portion of a top edge of the second side panel, a first cross member having slots engaged within grooves formed on the first and second side panels, and a second cross member having slots engaged with grooves formed in the first and second side panels. The first and second side panels have identical configurations. The first and second cross members have identical configurations. Each of the plurality of tile-receiving slots has a width dimension greater than a thickness of the tile to be received therein.

19 Claims, 4 Drawing Sheets

APPARATUS FOR THE DISPLAY OF TILE SECTIONS

TECHNICAL FIELD

The present invention relates to devices for the display of tile sections. More particularly, the present invention relates to displays in which tile sections can be easily observed, flipped through, removed, and otherwise observed. More particularly, the present invention relates to displays for tile sections which can be conveniently assembled, transported and stored.

BACKGROUND ART

In the setting of department stores, the display of merchandise often becomes a critical concern. Some merchandise may sell more rapidly in one location of a store than in another location. The introduction of new products for sale also creates problems as to the proper manner for displaying these products. In many instances, the inability to properly display merchandise can determine the success or failure of a product being offered for sale. Ultimately, this can reflect on the profitability of the store offering this merchandise for sale.

One display system was the subject of U.S. Pat. No. 4,780,349, issued on Oct. 25, 1988 to Gieske et al. This patent described a display system having a structural layer of rigid material with a plurality of holes extending therethrough, a plurality of laminate sections fastened to the structural layer in parallel relationship, a fastening material fastened to the structural layer in the area between the laminate sections, and an attachment cleat affixed to the side of the structural layer opposite the laminate sections. This structural layer is a sheet of pegboard material.

The display of tiles has also been a major problem for those stores which offer tile for sale. In the past, when tile is placed on display, it generally resides in flat surface-to-surface contact with a shelf in a display panel. While this flat display of the tiles is easy to view, it is very difficult to remove one of the tiles from the surface of the shelf for closer inspection. Additionally, it often takes a great deal of space to properly display the tiles in a side-by-side manner.

The lack of clearance between the underside of the tile and the top surface of the shelf makes such removal difficult. Customers often grow very dissatisfied whenever it is necessary to remove several samples for a side-by-side comparison. Under certain circumstances, the shelving lacks proper retaining surfaces. As a result, the tile can have a tendency to fall off the shelf and onto the floor. This results in the breakage of the display tile and also presents the possibility of injury to customers. In general, all of the display panels that have been used for the display of tile have been inadequate for their intended purpose.

One type of system has been employed in the past for the display of tile. This system utilizes flat shelves with holes formed through the shelf. As a result, a person can hook his or her finger through the hole so as to dislodge the tile from the surface of the shelf. Unfortunately, this technique causes the tile to fall off the shelf to the possible injury of others. In other circumstances, broken fingernails result from efforts in trying to remove the tile by this technique.

For any type of display system, it is important to be able to easily manufacture this display system at a minimal cost to the purchaser. In addition, it is necessary to create such a display system that can be easily stored, transported and assembled. If assembly becomes too difficult, then the purchaser may fail to properly assemble the display system. As a result, the display system may never be used or, if improperly assembled, may fall apart quickly after assembly. In other circumstances, tile stores may desire to move a display from one location to another within the store. Whenever it is necessary to move a display, it is important that the display be able to be disassembled in a minimal amount of time for removal and transport. The display may be irreparably damaged if it is difficult to disassemble and transport.

It is an object of the present invention to provide an apparatus for the display of tiles.

It is another object of the present invention to provide an apparatus which allows for the easy removal and inspection of tile.

It is a further object of the present invention to provide an apparatus for the display of tile which allows the tile to be stored in a convenient and safe manner.

It is another object of the present invention to provide an apparatus for the display of tiles which can be easily assembled and disassembled.

It is still a further object of the present invention to provide an apparatus for the display of tiles which allows a maximum number of tiles to be displayed in a minimal amount of space.

It is still a further object of the present invention to provide an apparatus for the display of tiles which allows the various tile sections to be fanned through easily.

It is still another object of the present invention to provide an apparatus for the display of tiles which is easy to use, easy to manufacture, easy to assemble, easy to store and relatively inexpensive.

These and other objects and advantages of the present invention will become apparent from a reading of the attached specification.

SUMMARY OF THE INVENTION

The present invention is an apparatus for the display of tile sections that comprises a first side panel, a second side panel, a first cross member and a second cross member. The first side panel has a plurality of tile-receiving slots extending along at least a portion of a top edge of the first side panel. These plurality of slots open along this top edge of the first side panel. The first side panel includes a first groove formed along another edge of the first side panel and a second groove formed in spaced relationship to the first groove. The second side panel has a plurality of tile-receiving slots extending along at least a portion of the top edge of the second side panel. The second side panel has a first groove formed along another edge of the second side panel and a second groove formed in the second side panel in spaced relationship to the first groove of the second side panel. The first cross member has a first slot engaged with the first groove of the first side panel and a second slot engaged with the first groove of the second side panel. The second cross member has a first slot engaged with the second groove of the first side panel and a second slot engaged with the second groove of the second side.

In the preferred embodiment of the present invention, the first side panel and the second side panel have identical configurations. The first side panel extends in parallel relationship to the second side panel. Similarly, the first cross member extends in parallel relationship to the second cross member. The first and second grooves of the first side panel open along a bottom edge of the first side panel. The first and second grooves of the second side panel open along a bottom edge of the second side panel. The slots of the cross members are slidably received by the grooves of the side panels. The first and second cross members have an identical configuration.

In the preferred embodiment of the present invention, each of the first and second side panels has a generally triangular configuration. The top edge is the hypotenuse of the triangular configuration. A tile section is removably received within the plurality of slots of the first side panel and the plurality of slots of the second side panel. Each of the plurality of slots has a width which is greater than the thickness of the tile section. Each of the plurality of slots resides in spaced parallel relationship to an adjacent slot of the plurality of slots. Each of the plurality of slots is at a different height than an adjacent slot of the plurality of slots.

DETAILED DESCRIPTION OF THE PRESENT INVENTION

Figure 1:
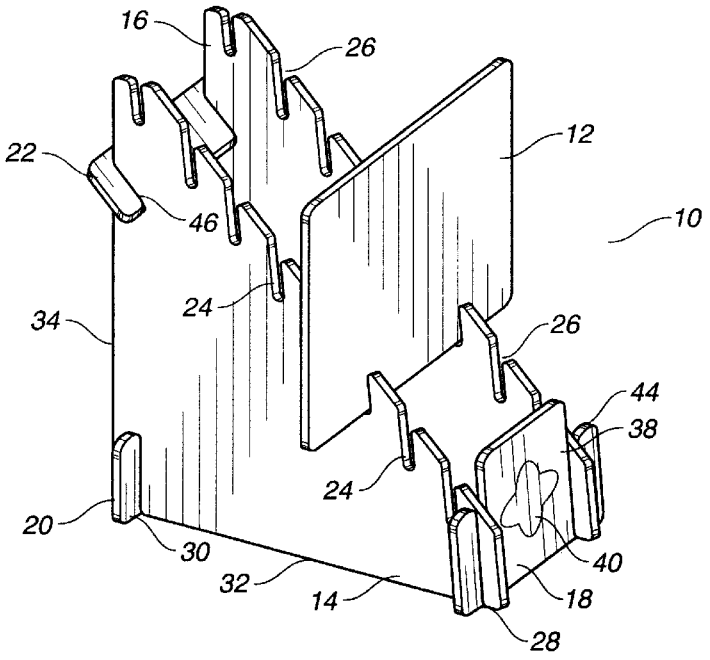
FIG. 1 is a perspective view of the preferred embodiment of the present invention.

Referring to FIG. 1, there is shown at 10 the apparatus for the display of tile section 12. The apparatus 10 includes a first side panel 14 and a second side panel 16. A first cross member 18 extends between the first side panel 14 and the second side panel 16. A second cross member 20 also extends between the first side panel 14 and the second side panel 16. A third cross member 22 further extends between the first side panel 14 and the second side panel 16.

As can be seen in FIG. 1, the first side panel has a plurality of tile-receiving slots 24 formed along a top of the first side panel. Each of the slots 24 extends in generally parallel relationship to an adjacent slot. As can be seen in FIG. 1, each of the slots 24 is positioned at a different height than an adjacent slot. The slots 24 generally increase in height as they progress from the front of the apparatus 10 toward the rear of the apparatus 10. Each of the slots 24 has a suitable width which can accommodate the thickness of the tile section 12.

As used herein, the term "tile section" can refer to any flat surface covering material for floors, walls, counter tops and fixtures. This can include marble tile, slate tile, granite tile, ceramic tile, clay tile, porcelain tile, glaze finished tile and polished tile. The term "tile sections" can further include carpeting sections that are placed on a flat display board or frame.

The second side panel 16 has an identical configuration to the first side panel 14. The second side panel 16 includes a plurality of slots 26 that extend along the top of the second side panel 16. Slots 26 are aligned with the slots 24 of the first side panel 14. As such, the tile section 12 can be received by corresponding slots in each of the side panels 14 and 16. The slots 24 and 26 are configured so as to display the tile section 12 in an upward, slightly angularly backward configured position. In normal use, each of the corresponding pair of slots 24 and 26 will receive separate tile sections along the top of the apparatus 10. As such, each tile section 12 will have an edge which appears slightly above the top edge of the adjacent tile section. As a result, users can easily see each of the tile sections in a convenient manner. The tile sections 12 can be stored in a compact and efficient manner. Furthermore, each of the tile sections 12 can be easily lifted from the corresponding slots 24 and 26 for closer observation and inspection. When various tile sections are received within the slots 24 and 26, the user can easily "fan" through the various tile sections 12 so as to select the desired tile for closer inspection.

In the present invention, the first side panel 14 includes a first groove 28 and a second groove 30 located along the bottom edge 32 of the first side panel 14. The second side panel 16, being of identical configuration, will include first and second grooves of similar configuration as grooves 28 and 30. The side vertical edge 34 also includes a groove which serves to receive the third cross member 22. It can be seen that the first groove 28 is spaced from the second groove 30 along the bottom edge 32. The first groove 28 on the first side panel 14 and the first groove in the second side panel 16 will receive the first cross member 18 therein in a particular interlocking manner. Similarly, the second groove 30 in the first side panel 14 and the second groove in the second side panel 16 will receive the second cross member 20. The cross members 18 and 20 will support each of the side panels 14 and 16 in an upright parallel spaced relationship. The third cross member 22 will further stabilize the positioning of the side panels 14 and 16 relative to each other.

In FIG. 1, it can be seen that the first cross member 18 has a front face 38. Front face 38 includes identification information 40 imprinted thereon. The identification information 40 can include the logo of the business in which the apparatus 10 is displayed, the logo of the manufacturer of the apparatus 10, or an identification of the type of tile received within the apparatus 10. Various other types of identification information can also be imprinted on the front face 38 of the first cross member 18.

The first cross member 18 includes a slot 42 which is slidingly received by and interlocked with the groove 28 of the first side panel 14. Similarly, the first cross member 18 includes a second slot 44 which is slidingly received by the corresponding groove 28 on the second side panel 16. The second cross member 20, as will be described hereinafter, has a similar arrangement of slots which are received within the corresponding grooves 30 on the first side panel 14 and the second side panel 16. The third cross member will have a similar configuration as the second cross member 30 and will be suitably received within a third groove 46 opening at side 34 of the first side panel 14 and a corresponding groove on the second side panel 16.

Figure 2:
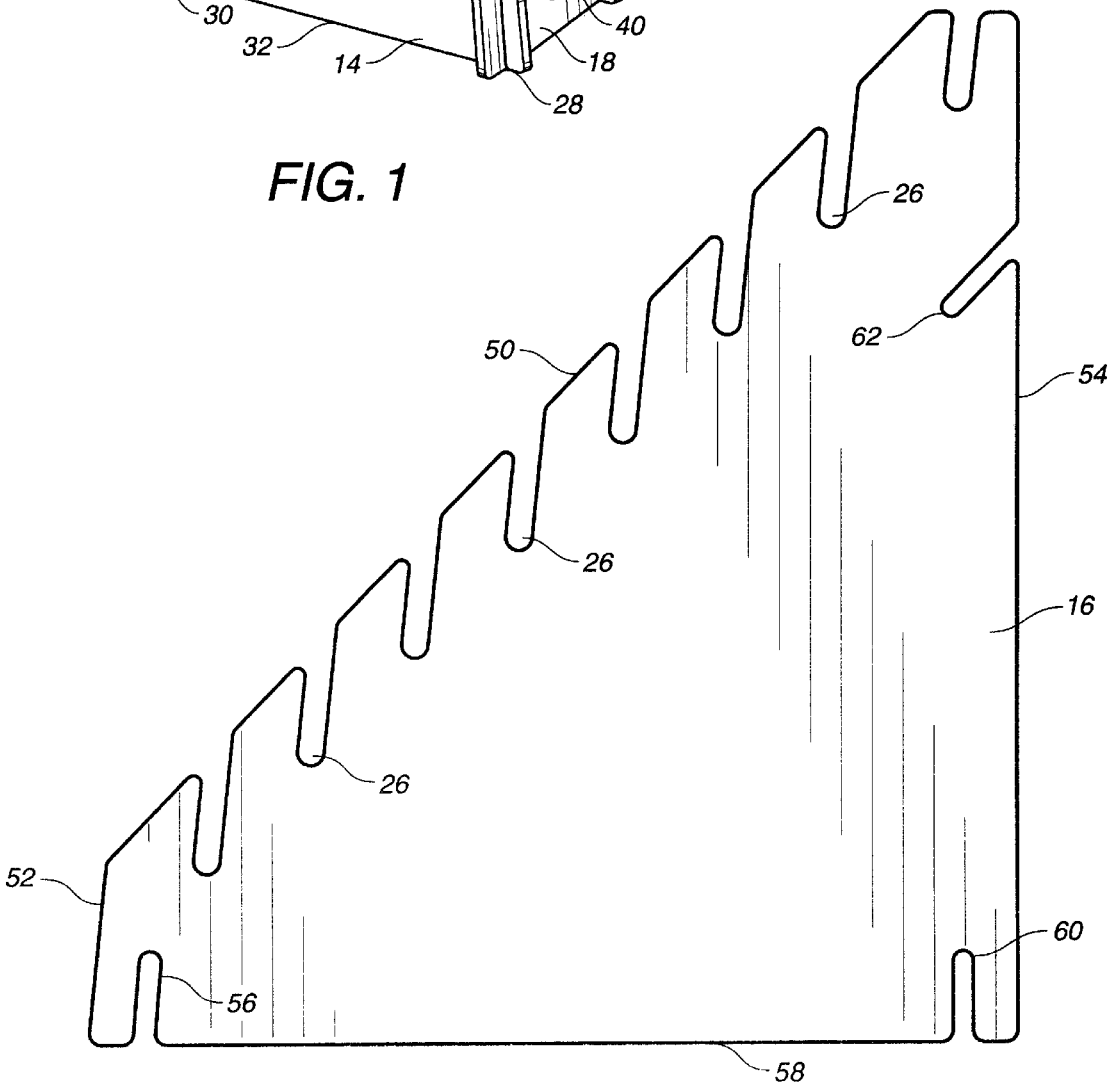
FIG. 2 is a side elevational view of a side panel as used in the preferred embodiment of the present invention.

FIG. 2 is an isolated view of the second side panel 16. As described herein previously, the second side panel 16 has an identical configuration as the first side panel 14. As such, the second side panel 16 can be manufactured with the same tooling used for the manufacture of the first side panel 14.

When disassembled, the second side panel 16 will lie flat against a surface of the first side panel 14 for easy storage and shipment.

As can be seen in FIG. 2, the second side panel 16 has a top edge 50 extending from the front 52 to the rear 54 of the second side panel 16. The panel 16 has a generally triangular configuration. The top edge 50 is the hypotenuse of this triangular configuration. The slots 26 extend into the top edge 50 such that each of the slots 26 opens at the top edge 50. The opening of each of the slots 26 allows for the easy receipt of the tile section 12 therein. A first groove 56 opens along the bottom edge 58 of the second side panel 16. The first groove 56 opens at a location adjacent to the front 52 of the second side panel 16. A second groove 60 also opens along the bottom edge 58 adjacent to the rear 54 of the second side panel 16. A third groove 62 opens along the back edge 54 and extends downwardly, at an acute angle, relative to the back edge 54. The first groove 56 will receive a corresponding slot in the first cross member 18. The second groove 60 will receive a corresponding slot in the second cross member 30. The third groove 62 will receive a corresponding slot in the third cross member 22.

Figure 3:
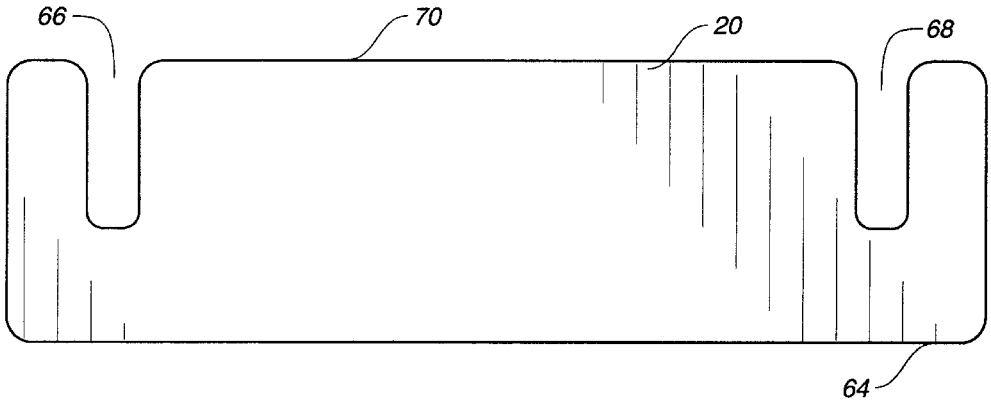
FIG. 3 is a frontal view of a cross member as used in the preferred embodiment of the present invention.

FIG. 3 is an isolated view of second cross member 20. As can be seen, the second cross member 20 has a flat bottom surface 64, a first slot 66, a second slot 68, and a top surface 70. The second cross member 20 has a generally rectangular configuration, but for the slots 66 and 68. The slot 66 serves to receive the groove 30 formed in the first side panel 14. The second slot 68 is slidingly received by the second groove 60 of the second side panel 16. The top edge 70 is generally in parallel relationship to the bottom edge 64. When the slots 66 and 68 are slidingly received by the corresponding grooves 30 and 60, the bottom edge 64 will rest against the surface onto which the apparatus 10 is placed. The side panels 14 and 16 will be suitably retained in their vertical parallel relationship by the interlocking relationship of the grooves and slots. The third cross member 22 will have an identical configuration as cross member 20.

Figure 4:
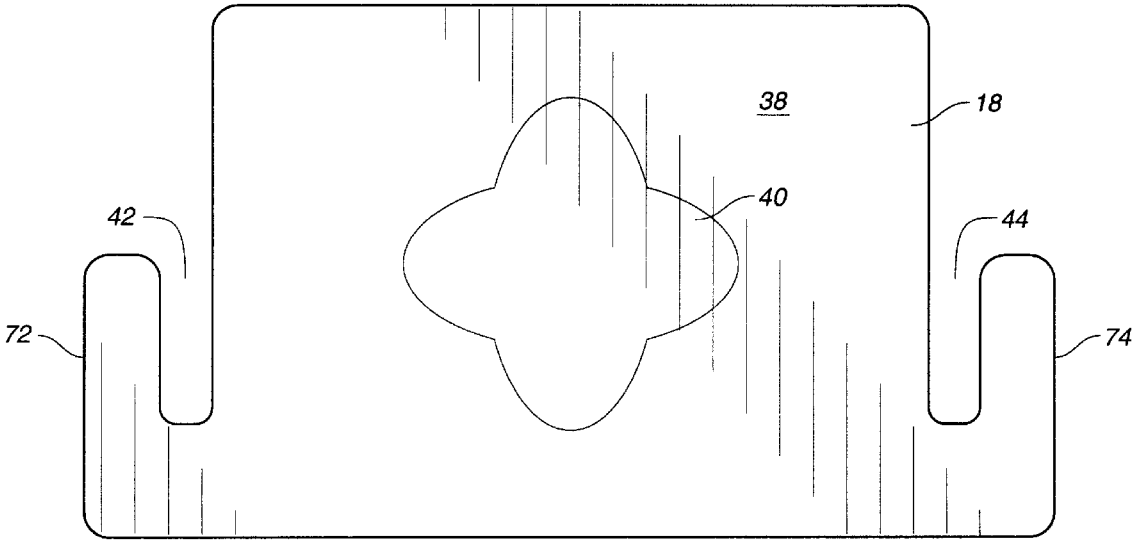
FIG. 4 is a front elevational view of another cross member as used in the preferred embodiment of the present invention.

FIG. 4 shows the configuration of the first cross member 18. As can be seen, the first cross member 18 has a front surface 38 with identification information 40 imprinted thereon. The front surface 38 has a height which is slightly greater than the remainder of the cross member 18. Slot 42 is formed along side 72 of the first cross member 18. Slot 44 is formed adjacent to the side 74 of the first cross member 18. The slot 42 will be slidingly received by the groove 28 of the first side panel 14. The slot 44 will be slidingly received by the corresponding groove of the second side panel 16.

Figure 5:
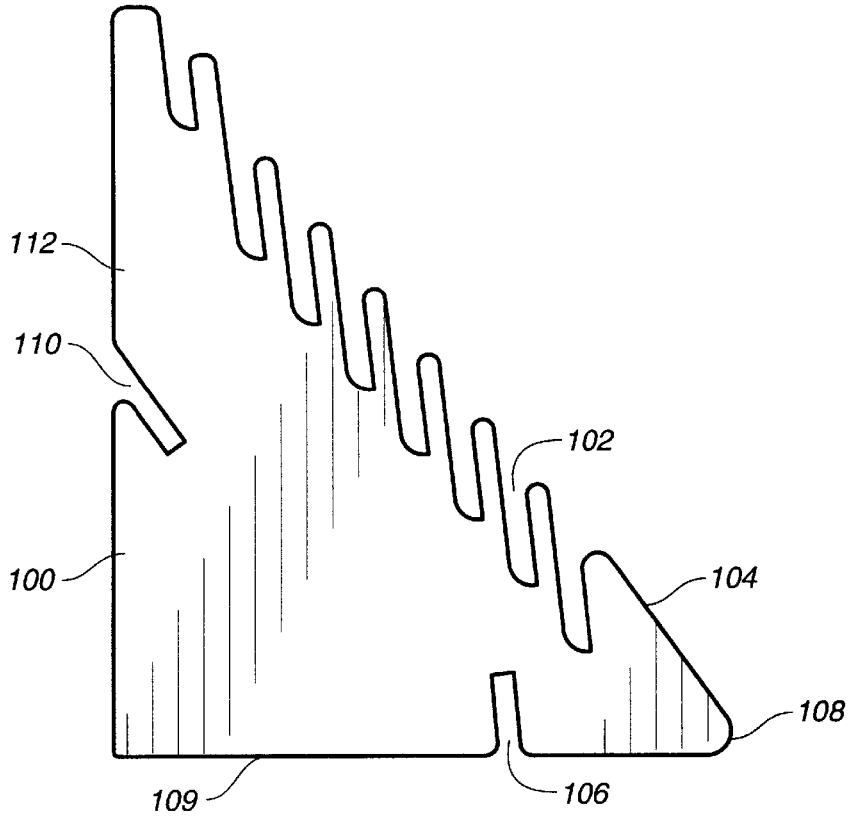
FIG. 5 is a side elevational view of an alternative side panel of the present invention.

FIG. 5 shows an alternative embodiment of the present invention which can utilize a side panel 100. The side panel 100 has a similar configuration as side panel 16 (illustrated in FIG. 2). Side panel 100 includes a plurality of slots 102 extending along a top 104 of the side panel 100. In FIG. 5, it can be seen that the side panel 100 has a first groove 106 positioned slightly rearwardly of the front edge 108 along the bottom edge 109 of the side panel 100. Additionally, a second groove 110 is located along the back edge 112. Each of the grooves 106 and 110 will receive cross members similar to that shown in FIG. 3. The second groove 110 extends angularly downwardly from the back edge 112 of the side panel 100. In this configuration, it can be seen that the present invention can be operated and assembled with a minimum of cross members. The cross members received within the grooves 106 and 110 will have an identical configuration. The side panel 100 is joined, through the use of the cross members, to a side panel of identical configuration.

Figure 6:
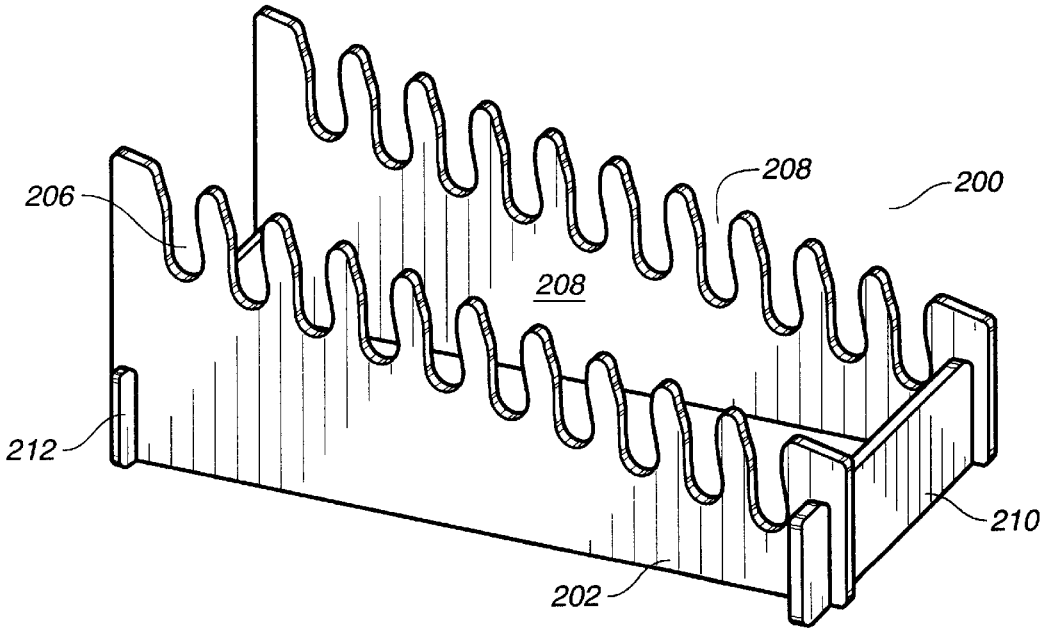
FIG. 6 is a perspective view of a first alternative embodiment of the present invention.

FIG. 6 shows an alternative embodiment 200 of the apparatus of the present invention. Apparatus 200 includes a first side panel 202, a second side panel 204, a plurality of slots 206 extending so as to open along a top edge of the first side panel 202 and a plurality of slots 208 opening along the top edge of the second side panel 204. A first cross member 210 is connected to the forward end of the side panels 202 and 204. A second cross member 212 is connected to the rear end of the side panels 204 and 206. The cross members 210 and 212 have a configuration similar to that shown in FIG. 3. Each of the side panels 202 and 204 include suitable grooves located at the front and rear of the side panel so as to receive the interlocking slots of the cross members 210 and 212. FIG. 6 shows the manner in which two cross members 210 and 212 can be used so as to secure the side panels 202 and 204 in their desired upright parallel relationship. Each of the grooves 206 and 208 has a generally rounded configuration of the bottom of each slot. This further facilitates the ability to fan between adjacent tile sections.

Figure 7:
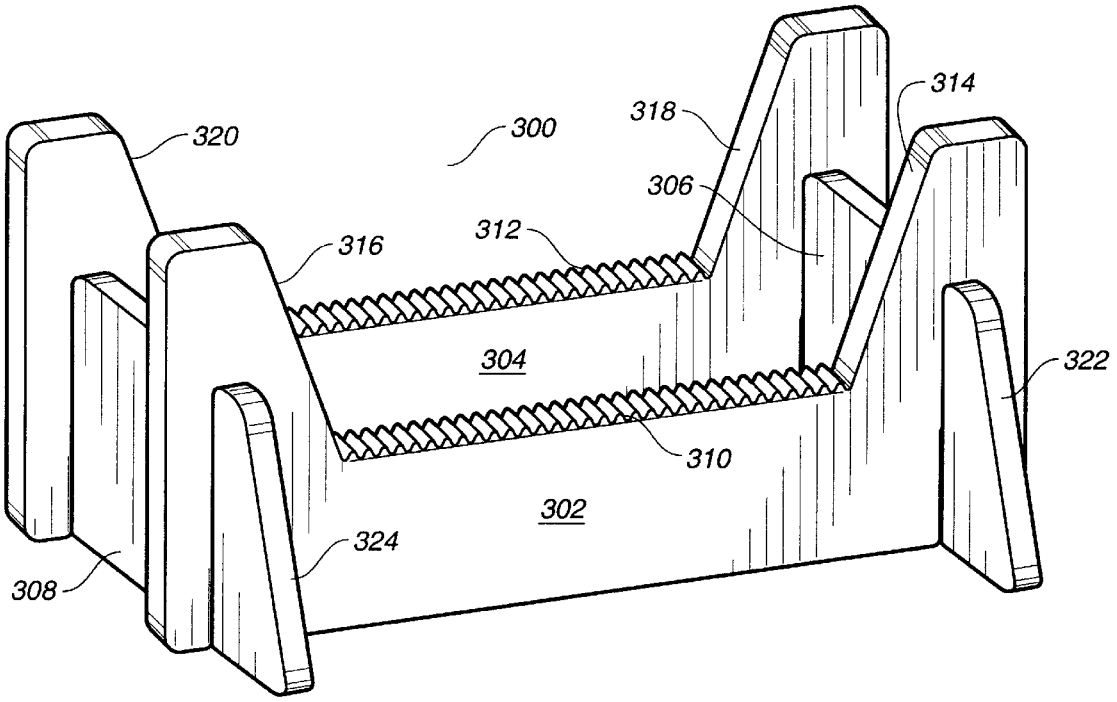
FIG. 7 is a perspective view of a second alternative embodiment of the present invention.

FIG. 7 shows another alternative embodiment 300 of the present invention. The apparatus 300 includes a first side panel 302, a second side panel 304, a first cross member 306 and a second cross member 308. In the configuration shown in FIG. 7, the first side panel 302 and the second sidepanel 304 have a plurality of grooves 310 and 312, respectively. These grooves are of minimal height in comparison with the grooves of the previous embodiment. The bottom edges of each of the tile sections are received within these grooves 310 and 312. The tile sections will extend between the grooves 310 and 312 of the side panels 302 and 304, respectively. The first side panel 302 includes a first upright abutment surface 314 and a second upright abutment surface 316 on opposite ends of the section which includes the plurality of slots 310. Abutment surfaces 314 and 316 allow the surfaces of the end tiles within the grooves 310 to rest thereon. This configuration 300 further facilitates the ability to "fan" between the various tile sections. The second side panel 304 also includes a first abutment surface 318 and a second abutment surface 320 at opposite ends of the plurality of slots 312.

In FIG. 7, it can be seen that the first cross member 306 has suitable slots which are received by grooves formed in the first side panel 302 and the second side panel 304. Similarly, the second cross member 308 has slots which are received within grooves formed in the first side panel 302 and the second side panel 304. Each of the cross members 306 and 308 is illustrated as having a configuration similar to that shown in FIG. 4 hereinbefore. However, the cross members 306 and 308 have outwardly tapering sides 322 and 324, respectively. These outwardly tapering sides further enhance the stability of the apparatus 300 and add to its aesthetic appeal.

Figure 8:
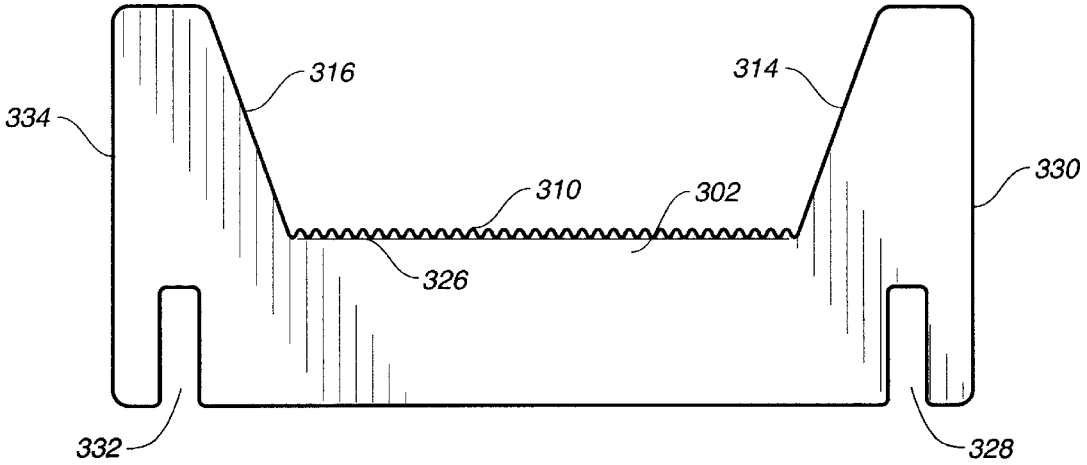
FIG. 8 is a side elevational view of a side panel as used with the second alternative embodiment of the present invention.

FIG. 8 is an isolated view of the first side panel 302. As can be seen, the plurality of slots 310 appears as a corrugated section. Abutment surfaces 314 and 316 extend upwardly from section 326 upon which the slots 310 are formed. It can be seen that the first side panel 302 has a first groove 328 adjacent to ends 330 of the first side panel 302. A second groove 332 is formed adjacent to the back end 334 of the first side panel 302. The second side panel 304 has an identical configuration as the first side panel 302.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A tile section display apparatus comprising:

a first side panel having a plurality of tile-receiving slots extending along at least a portion of a top edge of said first side panel, said plurality of slots opening at a top of said first side panel, said first side panel having a first groove formed along another edge of said first side panel and a second groove formed along an edge of said first side panel so as to be spaced from said first groove;

a second side panel having a plurality of tile-receiving slots extending along at least a portion of a top of said second side panel, said second side panel having a first groove formed along another edge of said second side panel and a second groove formed in said second side panel in spaced relationship to said first groove of said second side panel, each of said first and second side panels having a generally triangular configuration, said top edge being a hypotenuse of said triangular configuration;

a first cross member having a first slot engaged with said first groove of said first side panel, said first cross member having a second slot engaged with said first groove of said second side panel; and a second cross member having a first slot engaged with said second groove of said first side panel and a second slot engaged with said second groove of said second side panel.

2. The apparatus of claim 1, said first side panel and said second side panel having identical configurations.

3. The apparatus of claim 1, said first side panel extending in parallel relationship to said second side panel.

4. The apparatus of claim 3, said first cross member extending in parallel relationship to said second cross member.

5. The apparatus of claim 1, said first and second grooves of said first side panel opening along a bottom edge of said first side panel, said first and second grooves of said second side panel opening along a bottom edge of said second side panel.

6. The apparatus of claim 1, said first slot of said first cross member being slidably received by said first groove of said first side panel, said second slot of said first cross member slidably received by said first groove of said second side panel.

7. The apparatus of claim 6, said first slot of said second cross member slidably received by said second groove of said first side panel, said second slot of said second cross member slidably received by said second groove of said second side panel.

8. The apparatus of claim 1, said first and second slots of said first cross member opening along a top edge of said first cross member.

9. The apparatus of claim 8, said first and second slots of said second cross member opening along a top edge of said second cross member.

10. The apparatus of claim 1, said first and second cross members having identical configurations.

11. The apparatus of claim 1, said first cross member having a surface facing a front of said first and second side panels, said surface of said first cross member having identification information imprinted thereon.

12. The apparatus of claim 1, said first side panel having a third groove formed along another edge of said first side panel, said second side panel having a third groove formed along another edge of said second side panel, the apparatus further comprising:

a third cross member removably received in said third groove of said first side panel and in said third groove of said second side panel.

13. The apparatus of claim 12, said third groove of said first side panel extending angularly downwardly from said another edge.

14. The apparatus of claim 13, said first and second grooves of said first side panel opening along a bottom edge of said first side panel, said first and second grooves of said second side panel opening along a bottom edge of said second side panel, said third groove of said first side panel opening along a side edge of said first side panel, said third groove of said second side panel opening along a side edge of said third side panel.

15. The apparatus of claim 1, further comprising:

a tile section removably received within one of said plurality of slots of said first side panel and one of said plurality of slots of said second side panel.

16. The apparatus of claim 15, said tile section having a thickness dimension, each of said plurality of slots having a width dimension greater than said thickness dimension of said tile section.

17. The apparatus of claim 1, each of said plurality of tile-receiving slots being in spaced parallel relationship to an adjacent tile-receiving slot of said plurality of tile-receiving slots.

18. The apparatus of claim 17, each of said plurality of tile-receiving slots being at a different height than an adjacent tile-receiving slot of said plurality of tile-receiving slots.

19. The apparatus of claim 1, said first groove of said first side panel opening along a horizontal edge of said first side panel, said second groove of said first side panel opening along a vertical edge of said first side panel, said second groove of said first side panel extending angularly downwardly from said vertical edge.

* * * * *